US012336577B1

(12) United States Patent
Tognarelli

(10) Patent No.: US 12,336,577 B1
(45) Date of Patent: Jun. 24, 2025

(54) GRIPPING MITT

(71) Applicant: WOW GEAR, LLC, Santa Barbara, CA (US)

(72) Inventor: David Tognarelli, Goleta, CA (US)

(73) Assignee: WOW GEAR, LLC, Santa Barbara, CA (US)

( * ) Notice: Subject to any disclaimer, the term of this patent is extended or adjusted under 35 U.S.C. 154(b) by 0 days.

(21) Appl. No.: 18/445,786

(22) Filed: Feb. 1, 2024

Related U.S. Application Data

(63) Continuation-in-part of application No. 29/885,970, filed on Mar. 2, 2023, now Pat. No. Des. 1,052,977.

(51) Int. Cl.
*A41D 19/015* (2006.01)

(52) U.S. Cl.
CPC . *A41D 19/01547* (2013.01); *A41D 19/01529* (2013.01)

(58) Field of Classification Search
CPC ..... A41D 13/087; A41D 13/081; B26B 2029/066; B26B 29/00; B26B 2029/068; A47J 2043/04409
See application file for complete search history.

(56) References Cited

U.S. PATENT DOCUMENTS

| | | | | |
|---|---|---|---|---|
| D32,919 | S | 7/1900 | Turnbull | |
| 2,636,633 | A * | 4/1953 | Carlson | B26B 29/00 131/238 |
| 4,306,600 | A * | 12/1981 | Lonsinger, Jr. | B26D 7/22 30/151 |
| 7,744,137 | B2 * | 6/2010 | Mazyck | B42D 9/04 294/25 |
| D724,790 | S | 3/2015 | Hack | |
| 10,918,146 | B1 | 2/2021 | Dickerson | |
| 11,825,894 | B1 * | 11/2023 | Atkins | A41D 19/01517 |
| D1,052,977 | S | 12/2024 | Tognarelli | |
| 2005/0108802 | A1 * | 5/2005 | Burnett | A41D 13/087 2/16 |

(Continued)

FOREIGN PATENT DOCUMENTS

| | | | | |
|---|---|---|---|---|
| FR | 1478970 | A | 4/1967 | |
| WO | WO-2013071139 | A1 * | 5/2013 | A41D 13/087 |

OTHER PUBLICATIONS

Amazon.com. GripMitt, Silicone Kitchen Mitt, 2 Pack Set. ASIN: B0CG7VWKP. Date first available: Aug. 21, 2023, in 8 pgs.

(Continued)

*Primary Examiner* — Alissa L Hoey
*Assistant Examiner* — Akwokwo Olabisi Redhead
(74) *Attorney, Agent, or Firm* — Knobbe Martens Olson & Bear LLP

(57) ABSTRACT

The flexible gripping mitt is a hand tool for handling and retaining rigid and semi-rigid food and non-food items in order to cut, trim, slice, carve, pare or chop the item or perform other treatments such as painting, sanding and sculpting to non food items. The gripping mitt present disclosure is intended to allow a person to firmly hold and grip a variety of small items while working on the item being held. The gripping mitt protects from the temperature and liquids being emitted from the held item. It is also a hygienic guard for helping to minimize contamination of the held item and to prevent injuries, and allows for the hand to flex and move easily and freely to firmly grip and hold small food and non-food items.

10 Claims, 8 Drawing Sheets

(56) References Cited

U.S. PATENT DOCUMENTS

| | | | | |
|---|---|---|---|---|
| 2005/0160512 | A1* | 7/2005 | DeYoung | A41D 13/087 2/21 |
| 2007/0083968 | A1* | 4/2007 | Stokes | A41D 19/01505 2/16 |
| 2017/0215494 | A1* | 8/2017 | Savides | A47J 17/10 |

OTHER PUBLICATIONS

GRIPmitt by WOW GEAR, archived webpage: https://web.archive.org/web/20200923023858/https://wowcup.com/pages/gripmitt.

* cited by examiner

GRIPPING MITT

This application is a continuation-in part of design patent application Ser. No. 29/885,970, filed Mar. 2, 2023, herein incorporated by reference.

A gripping tool is disclosed having an integrated slicing guide and safety guard Brief Description of the Figures FIG. 1 is a perspective view of the flexible gripping mitt;

Figure 1:
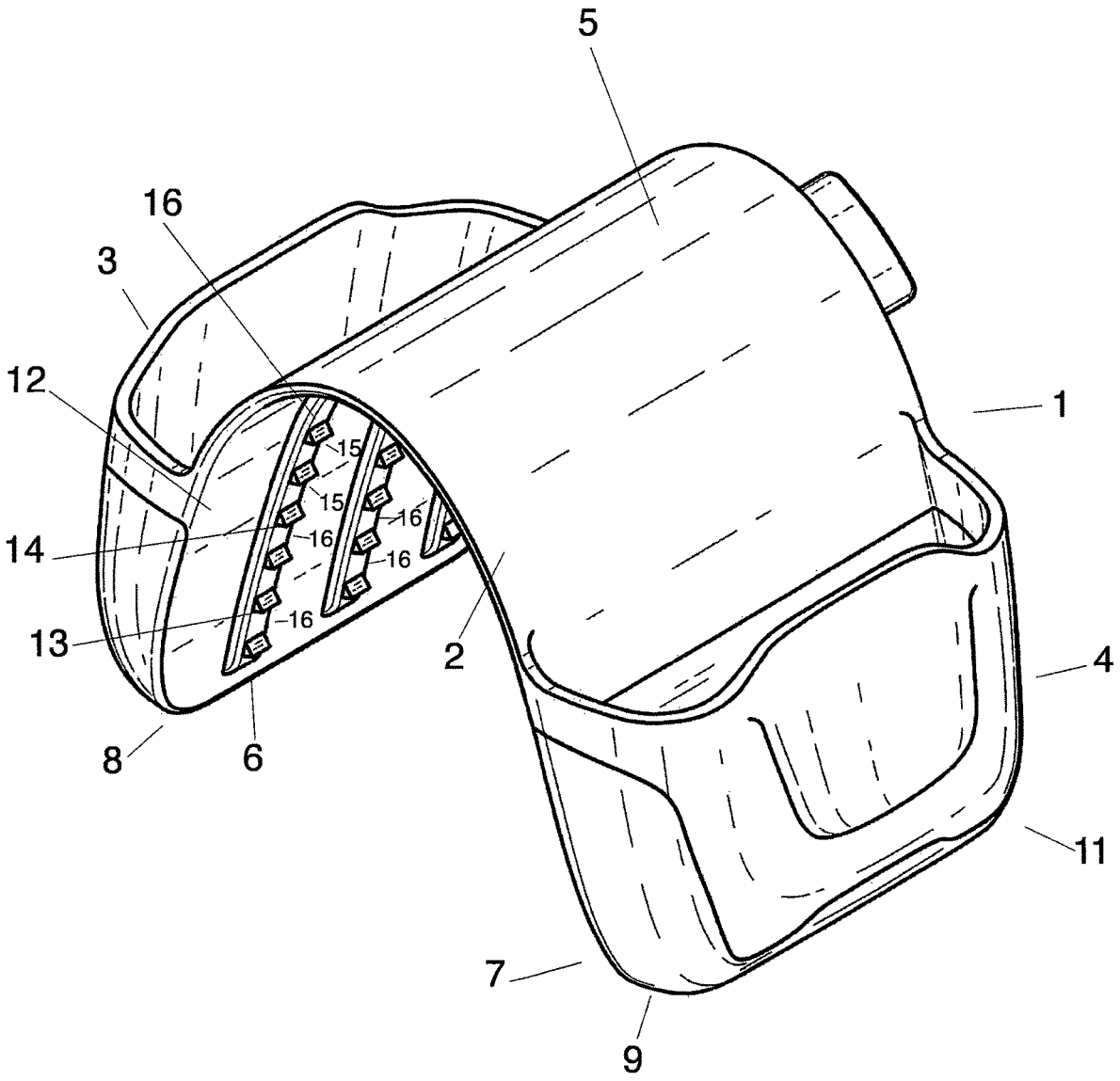
Figure 2:
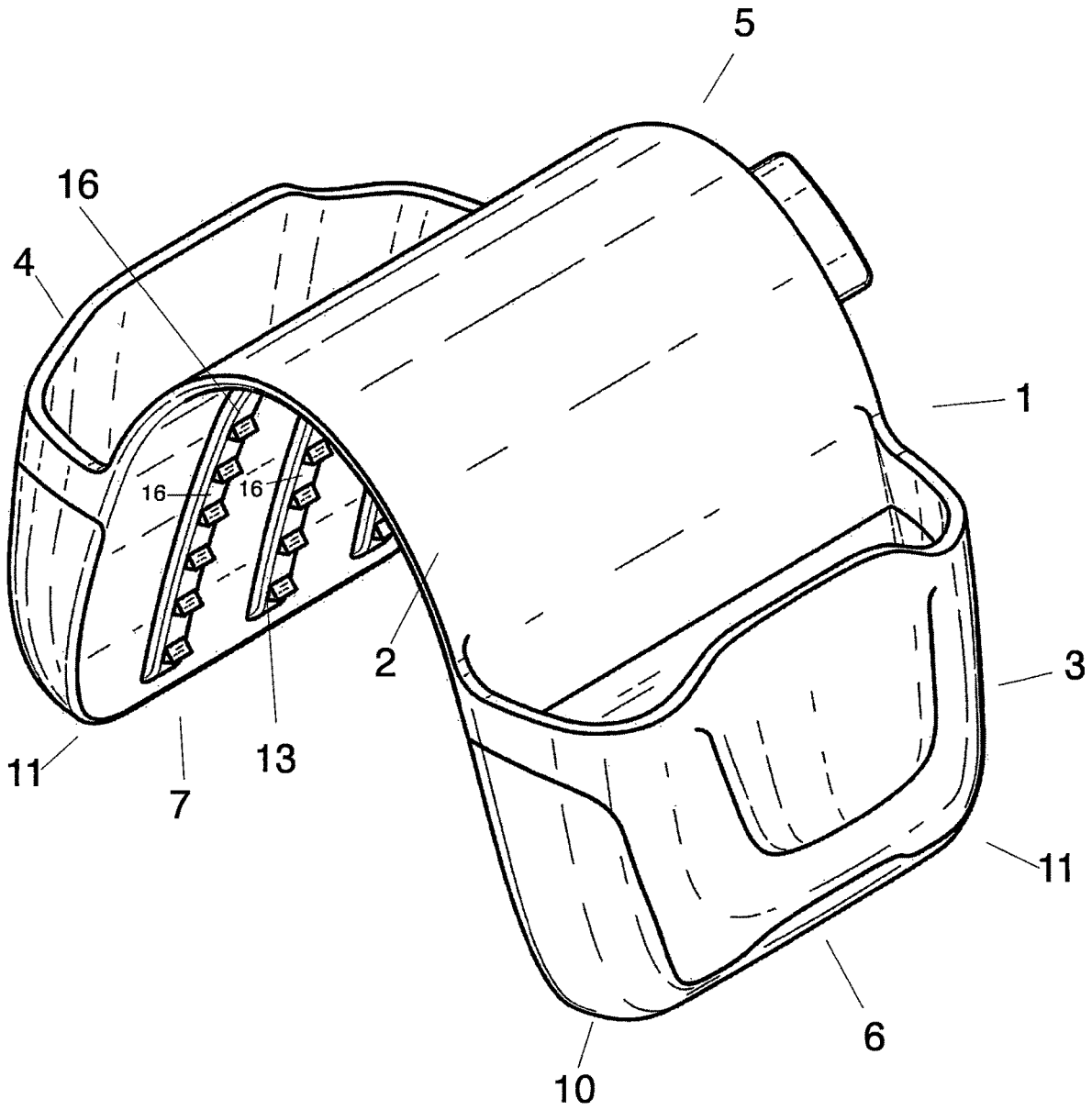
FIG. 2 is a reverse perspective view of FIG. 1.
Figure 3:
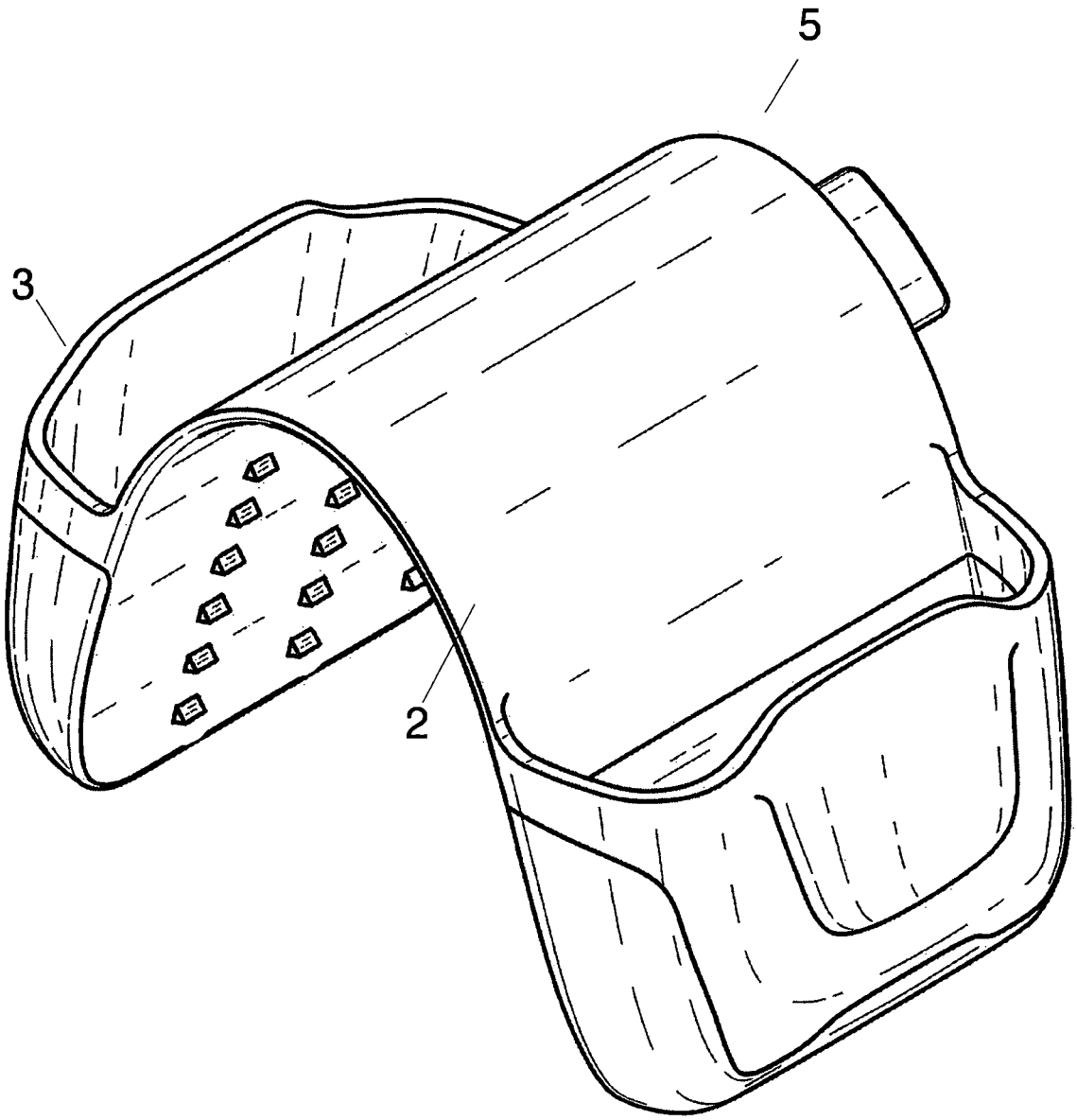
FIG. 3 is a perspective view of the opposite side of the flexible gripping tool of FIG. 1.
Figure 4:
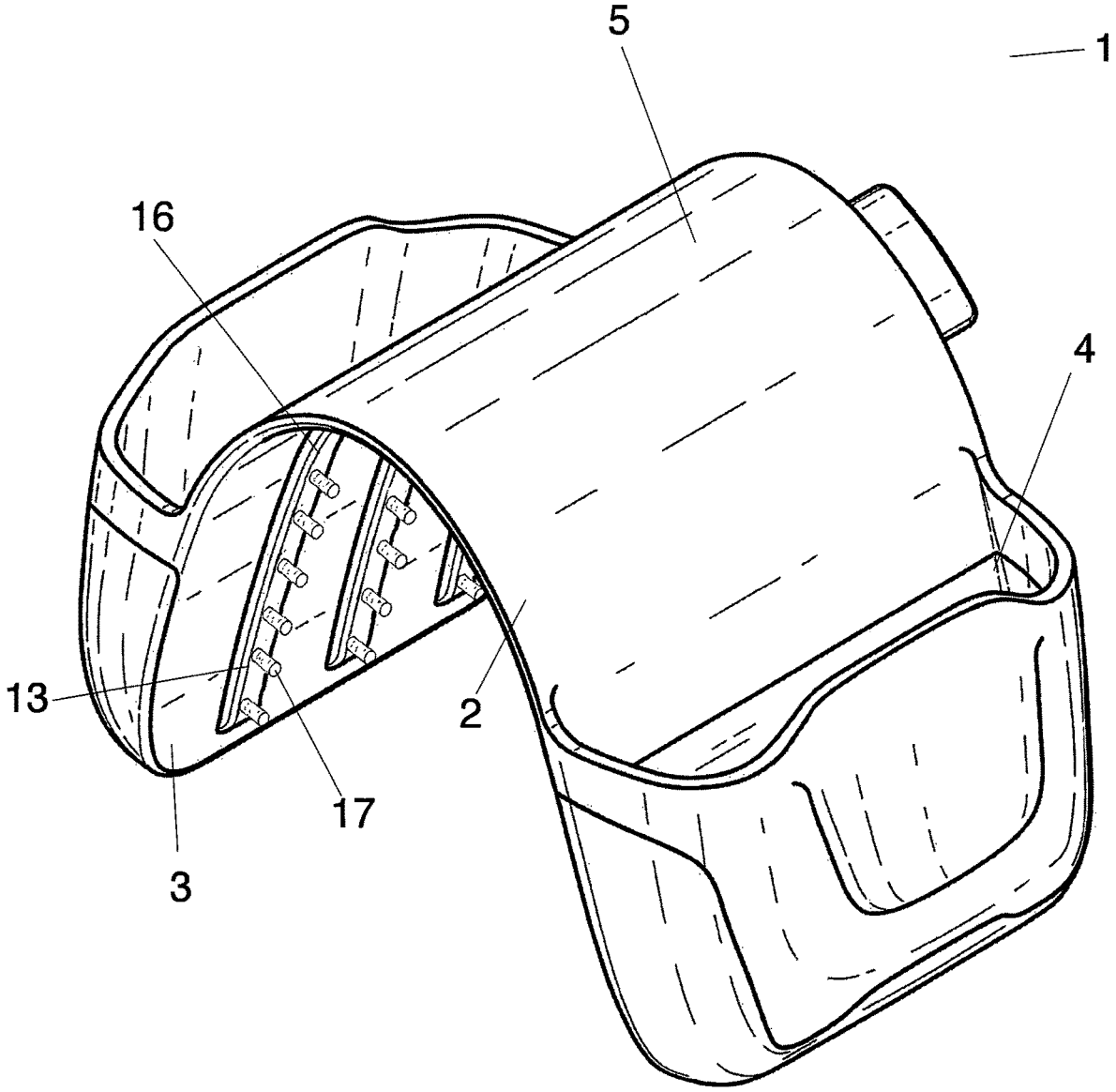
FIG. 4 is perspective view of an alternative embodiment of the grippers.
Figure 5:
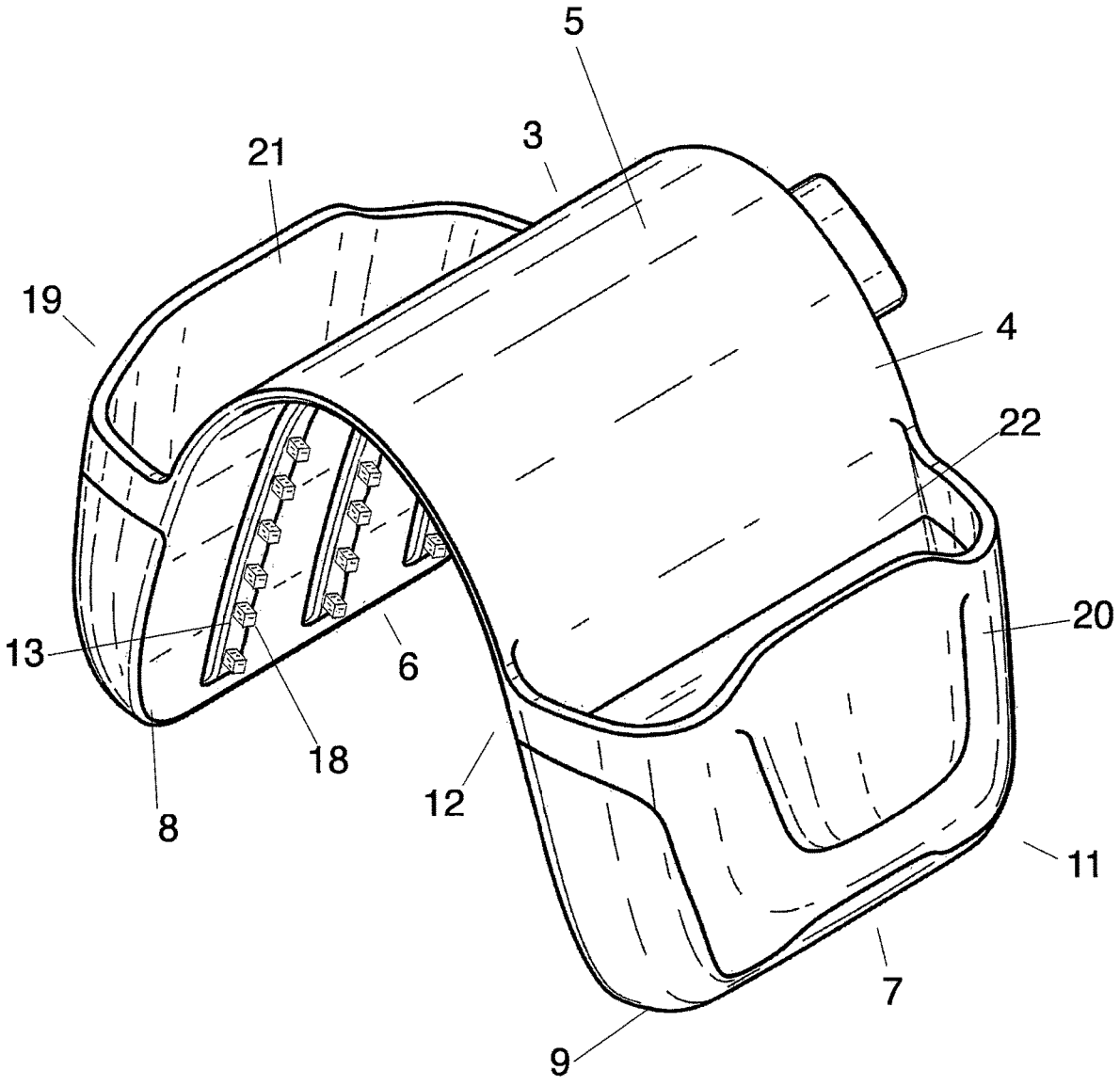
FIG. 5 is a perspective view of another alternative embodiment of the grippers.
Figure 6:
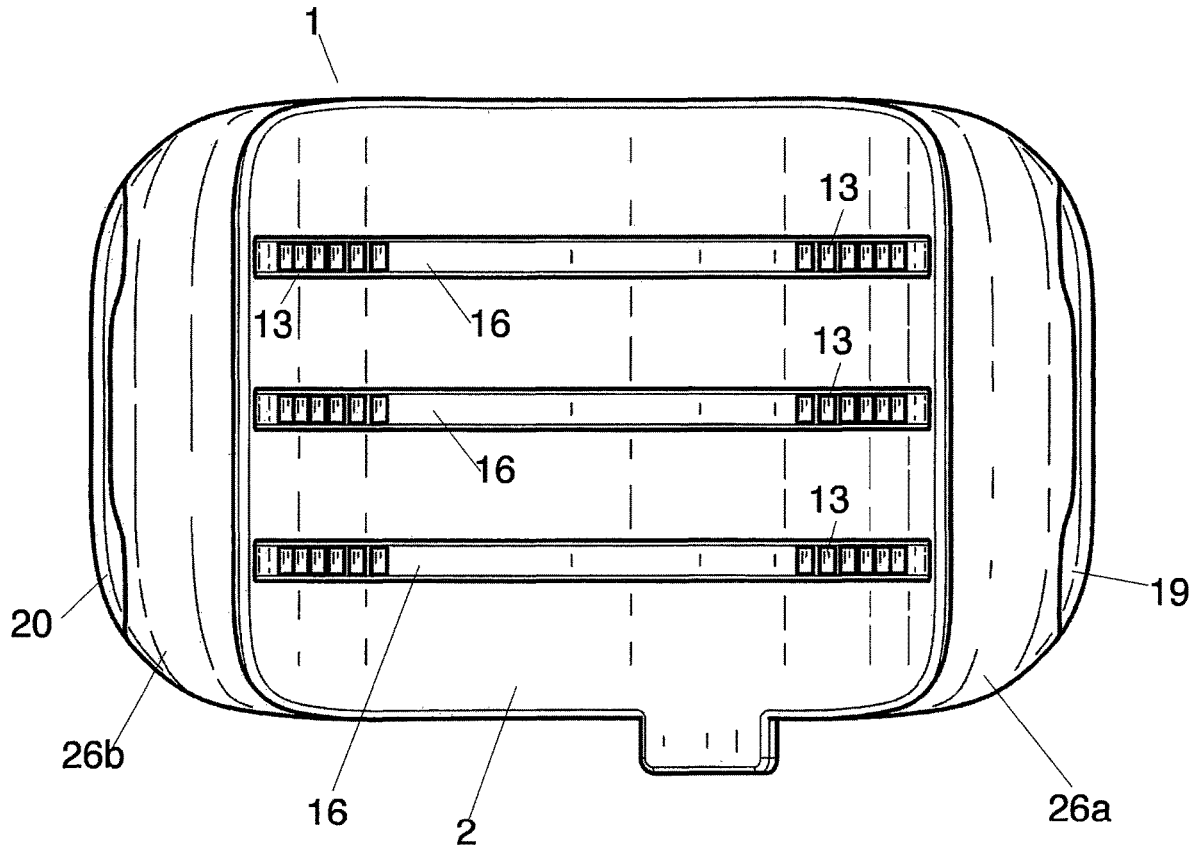
FIG. 6 is a bottom view of the gripping mitt.
Figure 7:
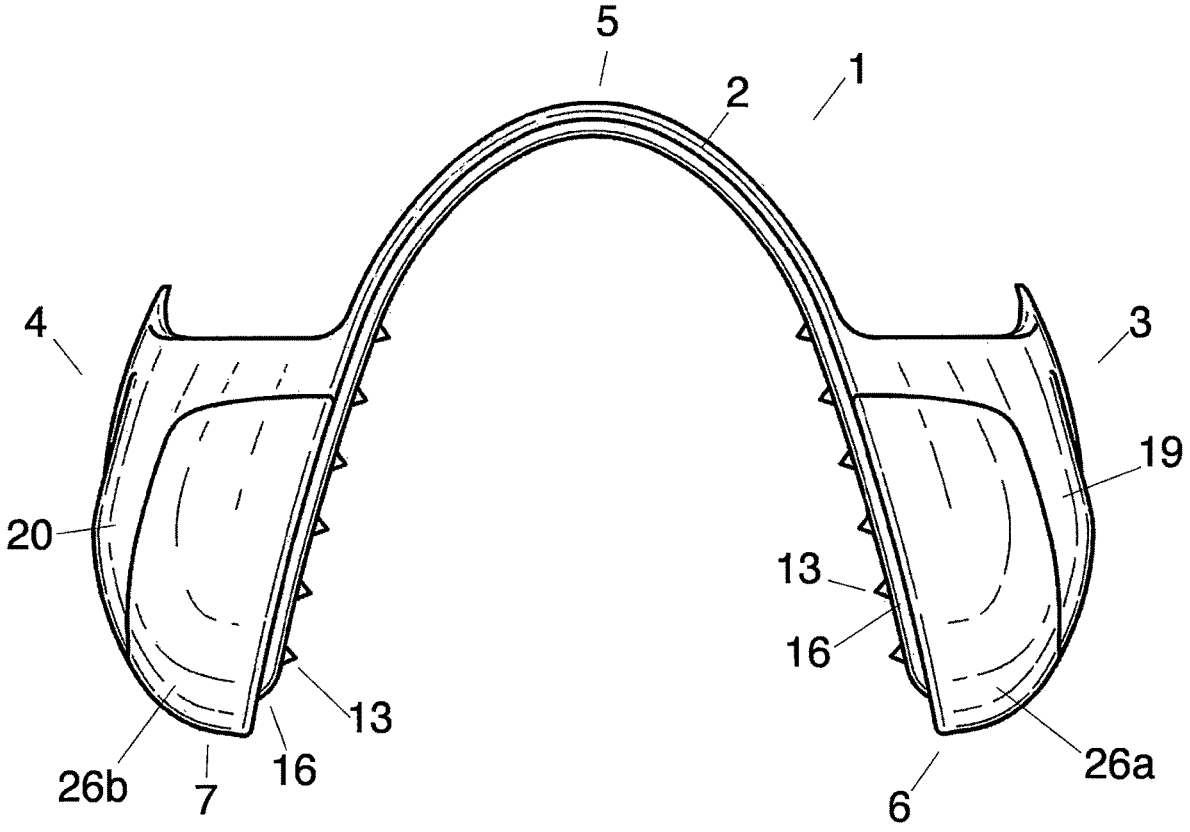
FIG. 7 is a side view of the gripping mitt.

The disclosure and its various embodiments can now be better understood by turning to the following detailed description of the preferred embodiments which are presented as illustrated examples of the disclosure defined in the claims. It is expressly understood that the disclosure as defined by the claims may be broader than the illustrated embodiments described below.

DETAILED DESCRIPTION OF THE EMBODIMENT

The flexible gripping mitt 1 is a hand tool for handling and retaining rigid and semi-rigid food and non-food items in order to cut, trim, slice, carve, pare or chop the item or perform other treatments such as painting, sanding and sculpting to nonfood items. The gripping mitt present disclosure is intended to allow a person to firmly hold and grip a variety of small items while working on the item being held.

The flexible gripping mitt is designed to protect from the temperature and liquids being emitted from the held item. It is also a hygienic barrier for helping to minimize contamination of the held item, and allows for the hand to flex and move easily and freely to firmly grip and hold small food and non-food items.

The mitt grip 1 has a flexible molded base 2. The base 2 is comprised of soft and semi rigid silicone or rubber materials, using materials approved for food contact. The material should be resistant to melting when in contact with higher temperatures, the higher temperatures ranging from about 200 to about 500 degrees. In some instances, certain plastics may be used that are resistant to melting at higher temperatures. The gripping mitt of the present disclosure is usable by either the left or right hand and is not handedness dependent. The materials used provide protection to the portion of the fingers and hand that is in contact with the surface of the tool when gripping hot, cold or room temperature food or non-food items from the heat or liquids emanating of from the held item. The gripping mitt is also useful for handling hot pans or food items while inserting into or out of the oven or barbecue grill, using one or two gripping mitts. Note that this item has industrial and lab applications.

The base 2 is curved when in use or, in another embodiment, lies flat when not in use. The base layer 2 has a first section 3, a second section 4 and a center section 5 connecting the first and section sections. In one embodiment the center section 5 is downwardly curved. In an alternative embodiment, the center section 5 is flat, but flexible so that it is downwardly bendable. The first section 3 has a first end 6 and the second section 4 has a has a second end 7. In one embodiment of the base 2, the front corners 8,9 and rear corners 10, 11 are rounded.

In one embodiment, on the underside 12 of the base 2 are a plurality of projections or grippers 13 that are triangularly shaped 14, each of which having an edge 15. The grippers 13 provide for additional gripping function by penetrating or compressing into the held item. The number of grippers is dependent on the size of the gripping mitt 1, and can vary from 10 to 100 or more. In one embodiment, the grippers 13 are positioned on a plurality of ribs 16 that are oriented along the length of the underside 12. The ribs provide additional form and strength to the base 2, providing a fixed form and structure during the use of the gripping mitt 1. The number of ribs 16 can vary depending on the size of the gripping mitt (which in different embodiments comes in different sizes), but in one embodiment, the number of ribs can range from 2 to 25 or more. The grippers 13 are positioned from about one quarter of an inch to about an inch from each other, and the ribs 16 are positioned from about a half inch to about two or more inches from each other. There are many variations to the number of ribs and grippers, with the understanding that there are enough ribs and enough grippers to hold any food items or any other items without risk of falling.

In one embodiment, the ribs run the length of the base 2. In another embodiment, the ribs 16 are slightly shorter than the length of the base 2. In one embodiment, there are a set of 3 ribs 16 on the underside of the base. In another embodiment, there are no grippers 13. Alternatively, there are no ribs 16 and the grippers 13 are attached directly to the underside of the base 2. In yet another embodiment, there are no grippers 13 nor are there any ribs 16. In yet another embodiment, the grippers 13 are cylindrical 17, rectangular 18, or any other practical shape. In another embodiment, the grippers 9 have no edge as with the triangularly shaped projections.

In one embodiment, the grippers 13 and the ribs 16 are integral with the base 2, such that they are part of the same molding process. In another embodiment, both or either of the grippers 8 and the ribs 16 are secured in their respective position by glue or some other adhesive. In another embodiment, the grippers 8 and the ribs 16 are heat sealed in their respective positions.

Attached to both ends of the first section 3 and the second section 4 are soft, flexible molded finger cupped pockets 19, 20 with the open end 21, 22 of the pockets 19, 20 facing upwards. This arrangement allows for the user to insert his or her thumb into one on the pockets 19, 20 while sticking two or three fingers into the other pocket. In one embodiment, The pocket can also accommodate four fingers. The center section 5 fits within the crook between the thumb and the fingers. In one embodiment the cupped pockets 19, 20 are integral with the base 2. The pockets allow the user to comfortably and securely squeeze the base so the grippers and the ribs securely hold the item in question.

In one embodiment, there is an undercut 23*a*, 23*b* molded into the outside perimeter of the two cupped pockets 19, 20 that incorporates a slotted channel 24*a*, 24*b* that runs along the top and side ends of the undercut. In one embodiment, within the undercut 23*a*, 23*b*, there are a plurality of depressed wedge shaped openings or holes 25*a*, 25*b* that extend throughout the length of the undercut 23*a*, 23*b*. In one embodiment, the holes 25*a*, 25*b* can also be virtually any other shape.

It should be noted that there are a number of different ways to manufacture the cupped pockets 19, 20. The silicone cup pockets band embodiment is molded as one unit by compression molding or liquid silicone injection molding processes and the Glass reinforced nylon plastic inserts are injection molded. The inserts are then attached to the silicone cupped pockets and are removable.

In another embodiment, the glass reinforced nylon plastic inserts are injection molded and then they are overloaded with silicone by either compression molding or liquid silicone injection molded. The inserts are permanently attached to the silicone cupped pockets and cannot be removed.

In one embodiment, the cupped pockets are glued to the base. Other means of attachment are also possible.

Another part of the assemblage includes semi-rigid or rigid guards 26*a*, 26*b*. The guards 26*a*, 26*b* are made of nylon or diffused nylon. In other embodiments, the guards are made from acrylonitrile butadiene styrene plastic, copolymer plastic, stainless steel, or high consistency silicone rubber. The purpose of the guards 26*a*, 26*b* is to provide further protection to finger tips when food is being cut while being held by the flexible gripping tool 1. More specifically, the guards provide additional rigidity to the present gripping mitts with the gripping section of the tool. The rigid material and its structures comes in contact with the held item at the same time the flexible bottom surface comes in contact with the held item during the gripping function. This dual compression effect allows for a firm and flexible grip of the held item. In one embodiment, there is at least one guard 26*a* attached to one cupped pocket 19. In the embodiments shown, two guards 26*a*, 26*b* are used, one for each cupped pocket 19, 20.

The guards 26*a*, 26*b* also help stabilize the tool against the surface that the held item is sitting on allowing for a stable processing of the food or non-food item which may include slicing, tripping, carving chopping, paring, painting, etc. The guards 26*a*, 26*b* also provide two additional functions to the gripping mitt 1 that include a slicing guide and a cut guard. As a slicing guide, the knife or cutting tool can be aligned on the side edge of the guard and held against the guard as the slice or cut is being made. As a cut guard, the guard's rigid material and structure will assist to protect the flexible portion of the gripping mitt from being cut or damaged.

The guards 26*a*, 26*b* have three sides including two side ends 28*a*, 28*b* and 29*a*, 29*b* and one bottom end 30*a*, 30*b* all with projections to fit snuggly within the openings or holes 24*a*, 24*b*. In one embodiment, there are ten sets of two triangles 34*a*, 34*b* and each set of two triangles forms the outer shape of a wedge that are complementary to the holes. In another embodiment, other shapes that are complementary to the holes or openings 25*a*, 25*b* are used.

There is a lip 27*a*, 27*b* along the side ends 28*a*, 28 29 and the bottom perimeter 30 of the guards 26*a*, 26*b*. The lip 27*a*, 27*b* is undercut from the outer surfaces of the guards 26*a*, 26*b* and protrudes beyond the outer surfaces of the guards 26*a*, 26*b*. In one embodiment, to hold the guards in place, the lips 27*a* inserted into the slotted channel(s) 24 of the cupped pockets 19, 20.

In one embodiment, the guards 26*a*, 26*b* are reversibly attachable, allowing for easy cleaning. In another embodiment, they are permanently affixed. In yet another embodiment, there is only one side of the flexible gripping mitt that has the guard. In yet another embodiment, the guards 26*a*. 26*b* are glued to the bottom and sides of the cupped pockets 19, 20.

In yet another embodiment, the guards 26*a*, 26*b* are glued to the cupped pockets 19, 20.

Figure 8:
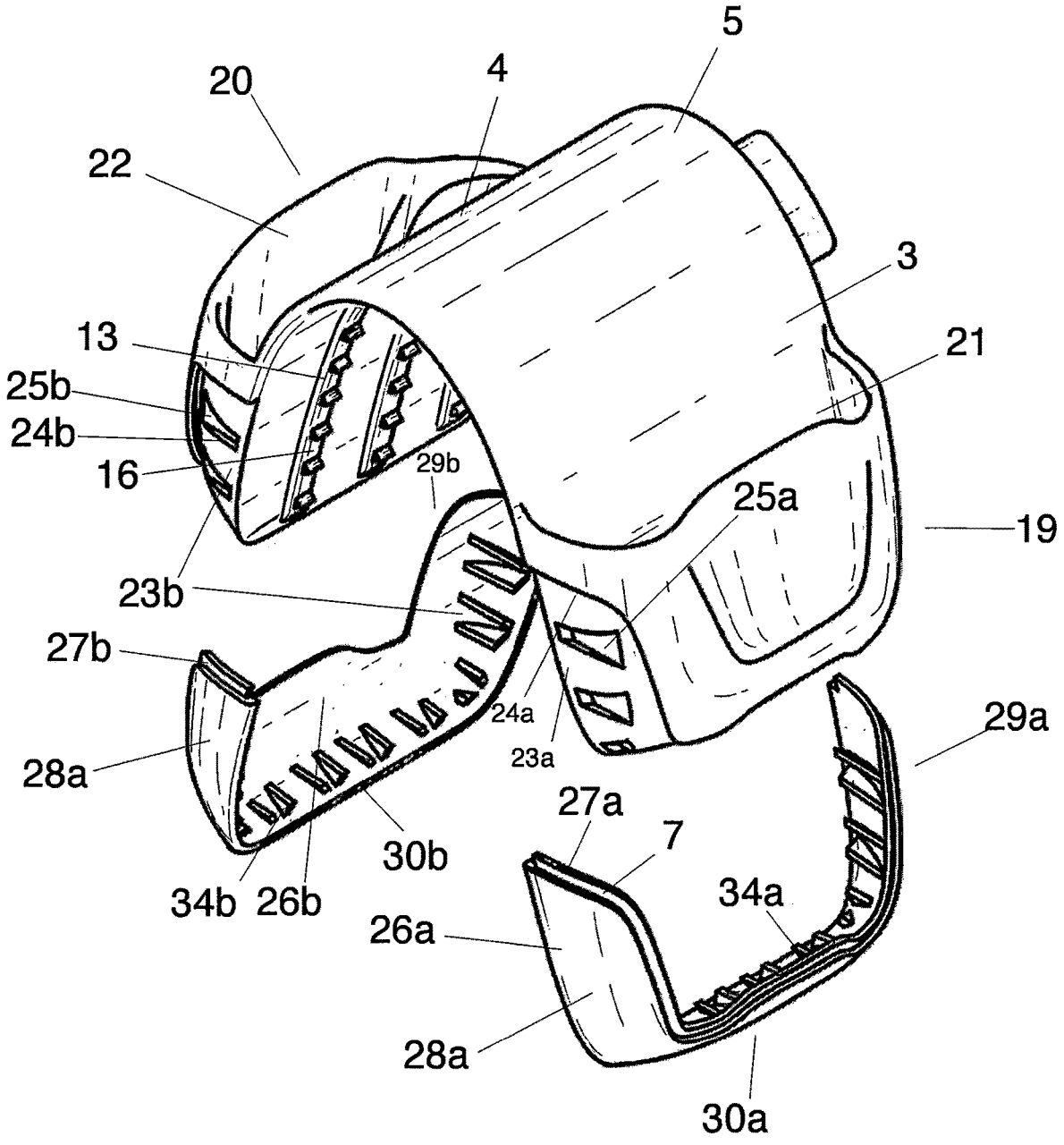
FIG. 8 is an exploded view of the gripping mitt.

Referring to at least FIG. 1 and FIG. 8, in some embodiments, the device according to the present disclosure can include exposed grippers, a guard, a thumb pocket, and/or a finger pocket. The thumb pocket and/or the finger pocket can include an upper opening. In some embodiments, the guard can be a U-shaped guard and can include a plurality of projections. In some embodiments, the grippers can be exposed grippers.

The description of the disclosure and its applications as set forth herein is illustrative and is not intended to limit the scope of the disclosure. Features of various embodiments may be combined with other embodiments within the contemplation of this disclosure. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the disclosure.

The invention claimed is:

1. A gripping mitt configured to grip a food item, said gripping mitt comprising:

a finger pocket configured to receive a plurality of a user's fingers, the finger pocket comprising:

a flexible portion comprising:

an outer side;

an inner side comprising a plurality of exposed grippers;

a bottom;

a first lateral side and a second lateral side; and an upper opening; and a U-shaped guard comprising a plurality of projections, the U-shaped guard extending along the bottom, first lateral side, and second lateral side of the flexible portion of the finger pocket, the U-shaped guard being harder than the flexible portion of the finger pocket, wherein the finger pocket further comprises openings configured to mate with and receive a respective one of the plurality of projections;

a thumb pocket configured to receive the user's thumb, the thumb pocket comprising:

a flexible portion comprising:

an outer side;

an inner side comprising a plurality of exposed grippers;

a bottom;

a first lateral side and a second lateral side; and an upper opening; and a U-shaped guard comprising a plurality of projections, the U-shaped guard extending along the bottom, first lateral side, and second lateral side of the flexible portion of the thumb pocket, the U-shaped guard being harder than the flexible portion of the thumb pocket, wherein the thumb pocket further comprises openings configured to mate with and receive a respective one of the plurality of projections; and a center section movably connecting the finger and thumb pockets such that the food item is grippable by and between the plurality of exposed grippers of the finger and thumb pockets, wherein the plurality of exposed grippers extend along their respective inner side of the flexible portion between the finger pocket and the thumb pocket.

2. The gripping mitt of claim 1, wherein the flexible portion of the finger pocket and the flexible portion of the thumb pocket comprise silicone or rubber.

3. The gripping mitt of claim 1, wherein said center section is bent downwards.

4. The gripping mitt of claim 1, wherein said center section is flat.

5. The gripping mitt of claim 1, wherein said plurality of exposed grippers of the finger pocket are triangular, rectangular, or cylindrical.

6. The gripping mitt of claim 1, further comprising a plurality of ribs positioned on the inner side of the finger pocket.

7. The gripping mitt of claim 6, wherein said plurality of grippers of the finger pocket are positioned on said plurality of ribs.

8. The gripping mitt of claim 1, wherein the finger pocket and thumb pocket are molded to the center section.

9. The gripping mitt of claim 1, wherein the U-shaped guards of the finger pocket and thumb pocket are made of glass diffused nylon, nylon, acrylonitrile butadiene styrene plastic, copolymer plastic, stainless steel, or high consistency silicone rubber.

10. The gripping mitt of claim 1, wherein said U-shaped guard of the finger pocket is glued to the bottom of the flexible portion of the finger pocket.

* * * * *